United States Patent [19]

Mitchell

[11] 4,009,670

[45] Mar. 1, 1977

[54] ROTARY HOOK SEWING MACHINE

[76] Inventor: Beatty Thomas Mitchell, 4800 Baja Court NE., Albuquerque, N. Mex. 87111

[22] Filed: Nov. 24, 1975

[21] Appl. No.: 634,776

[52] U.S. Cl. ..... 112/231; 112/258

[51] Int. Cl.[2] ..... D05B 57/14

[58] Field of Search ..... 112/228, 230, 231, 181, 112/260, 258

[56] References Cited

UNITED STATES PATENTS

| | | | |
|---|---|---|---|
| 388,323 | 8/1888 | Vannett | 112/231 |
| 2,808,797 | 10/1957 | Ayres | 112/260 |
| 2,965,057 | 12/1960 | Lakin | 112/231 |
| 3,067,703 | 12/1962 | Gustin | 112/230 |
| 3,071,091 | 1/1963 | Erbland | 112/260 |
| 3,476,068 | 11/1969 | Preston | 112/231 |

*Primary Examiner*—George H. Krizmanich
*Attorney, Agent, or Firm*—William C. Bowers

[57] ABSTRACT

In a rotary hook, lockstitch, stationary bobbin case sewing machine, a bobbin is mounted on a bobbin ejector carried on the center post of an open ended bobbin case. A thread tensioner is attached to the outside of the bobbin case. Illumination is provided and the thread supply can be viewed at any time through a magnifying window and the exposed flange of the bobbin. Release of a latch on the center post permits removal and replacement of the bobbin without detaching any other part.

4 Claims, 5 Drawing Figures

ROTARY HOOK SEWING MACHINE

BACKGROUND OF THE INVENTION

1. Field of the Invention

This invention relates primarily to the stitch-forming section of a sewing machine in which a bobbin is installed in a stationary bobbin case inside a rotary hook which is mounted on a horizontal shaft and rotates in a vertical plane.

2. Description of the Prior Art.

In prior art, in a sewing machine of the rotary hook and stationary bobbin type, a bobbin is usually mounted on a center sleeve or tube in a bobbin case cap which is installed over a center post in a bobbin case base rotatably mounted and retained in the rotary hook. A bobbin tension device is usually mounted on the exterior of the closed end of the bobbin case cap and a latch on the cap secures the cap to the end of the center post. The bobbin case cap has a bobbin extractor mechanism which, when the bobbin case cap is unlatched, grasps a flange of the bobbin. Removal of the bobbin case cap also removes the bobbin from the bobbin case base. To remove and replace the bobbin, the operator must remove the bobbin case cap which is subject to loss and damage. When installed, the bobbin and thread thereon are obscured by the bobbin case cap and the operator cannot ascertain the amount of thread on the bobbin. PRESTON, U.S. Pat. No. 3,476,068, eliminates the bobbin case cap; a latch is mounted on the center post of his bobbin case and a separate bobbin ejector mechanism is mounted on the sidewall of the bobbin case; means for applying tension to the bobbin thread applies a drag or braking force directly to a flange of the bobbin. The tension applied is described as independent of the type or thickness of the bobbin thread, but the tension must vary inversely as the amount of thread on the bobbin if the friction applied to the bobbin is constant. Transparent bobbins and bobbins with cutouts are known, as are viewing windows.

SUMMARY

The invention is an improvement to a rotary hook, lockstitch, stationary bobbin case sewing machine in which the rotary hook is mounted on and rotated by a horizontal shaft. The bobbin case has an automatic bobbin ejector, a thread tensioner mounted on the outside of the bobbin case sidewall, and a bobbin latch mounted on a center post, all of which expose the bobbin thread to view through a flange of the bobbin with the aid of a miniature light bulb and a magnifying view window in the front of the machine.

An object of the invention is to eliminate the usual bobbin case cap and thereby obviate the inconvenience and expense occasioned by its loss and damage. Another objective is elimination of any requirement to remove any other part in order to remove and replace the bobbin. A further objective is to provide means for easy inspection of the state of the bobbin thread supply. A final objective is to accomplish these results without the sacrifice of performance. To do this it is necessary to replace the functions performed by the bobbin case cap in latching the bobbin in place within the bobbin case, providing means for ejection of the bobbin to permit its removal, and to relocate the thread tensioning device. The thread tension device provided functions in accord with accepted and proven principles, it applies tension directly to the bobbin thread independent of the amount of thread on the bobbin and is satisfactorily located within the narrow confines of the rotary hook casing by attaching it directly to the outside wall of the open ended bobbin case. A bobbin ejector installed on the bobbin case center post provides necessary ejection and the latch attached to the center post provides the latching function. Having accomplished the foregoing, a miniature light bulb and a magnifying view window permit inspection of the thread supply through the exposed flange of a bobbin designed to expose the thread thereon.

DESCRIPTION OF THE PREFERRED EMBODIMENT

Figure 1:
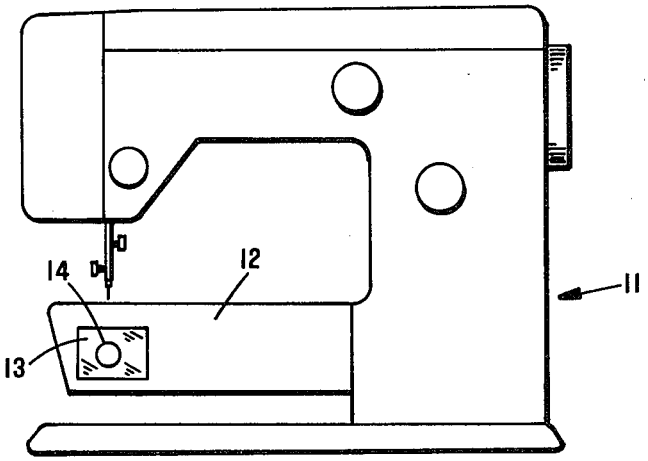
FIG. 1 is a front view, or elevation, of a free arm sewing machine incorporating the invention.

Referring to the drawings, FIG. 1 shows a rotary hook, lock stitch, stationary bobbin case sewing machine referred to generally as 11, with a free arm 12 in which there is an access door 13 and a magnifying lens view window 14 installed therein. Directly behind access door 13 is a rotating hook assembly designated generally as 15 in FIGS. 2, 3, and 4. The hook assembly 15 includes a hook casing 16 of known construction mounted on and rotated by a horizontal shaft 17. Hook casing 16 has a main hook 18 which picks up a loop of thread 19 from a reciprocating needle 20, when that needle is at its lowest point of travel, and forms a lock stitch in cooperation with bobbin thread 21. Mounted to the outside of hook casing 16 is a curved plate 22, also of known construction, which carries a secondary hook 23 outside the main hook 18 forming a slot 24 which receives thread 19 during the looping of that thread over the bobbin thread 21. Hook casing 16 rotates in the direction indicated by arrow A.

A bobbin case 25 having cylindrical sidewalls and being closed at one end is provided with an annular projection or flange 26 part of the way around its circumference which is received in a raceway groove 27 inside the cylindrical wall of hook casing 16, thus retaining the bobbin case 25 within the hook casing 16 and providing for relative rotation between bobbin case 25 and hook casing 16. Bobbin case 25 is held stationary by a position finger 28, the operative end of which is shown only on FIG. 3, pivoted from the frame of the free arm 12, which attachment is of known construction and not shown, into a position finger slot 29 in the outer edge of the sidewall of bobbin case 25, and thus bobbin case 25 is maintained in proper orientation within the sewing machine 11 when hook casing 16 is rotated about bobbin case 25 by horizontal shaft 17. Bobbin case 25 also has, directly behind position finger slot 29, a needle aperture 30 which receives the tip of needle 20 at its lowest point of travel.

Figure 3:
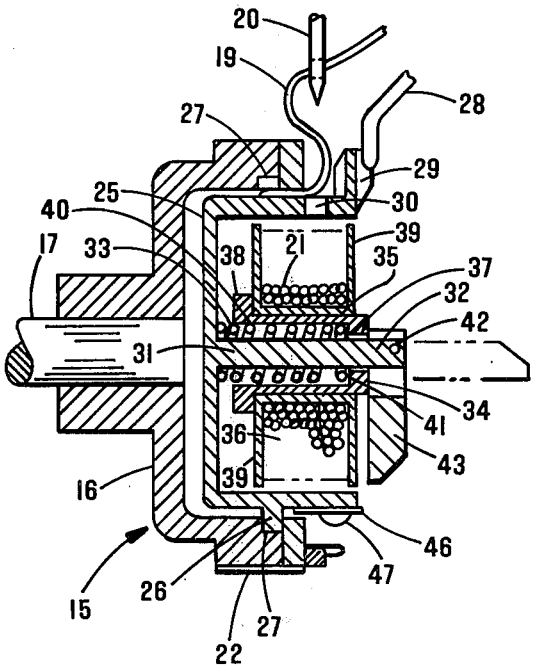
FIG. 3 is a section cut on line 3—3 on FIG. 2.
Figure 5:
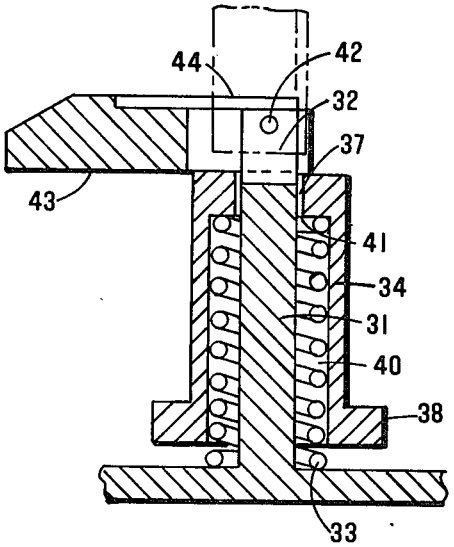
FIG. 5 is a sectional view of a bobbin latch assembly.
Figure 4:
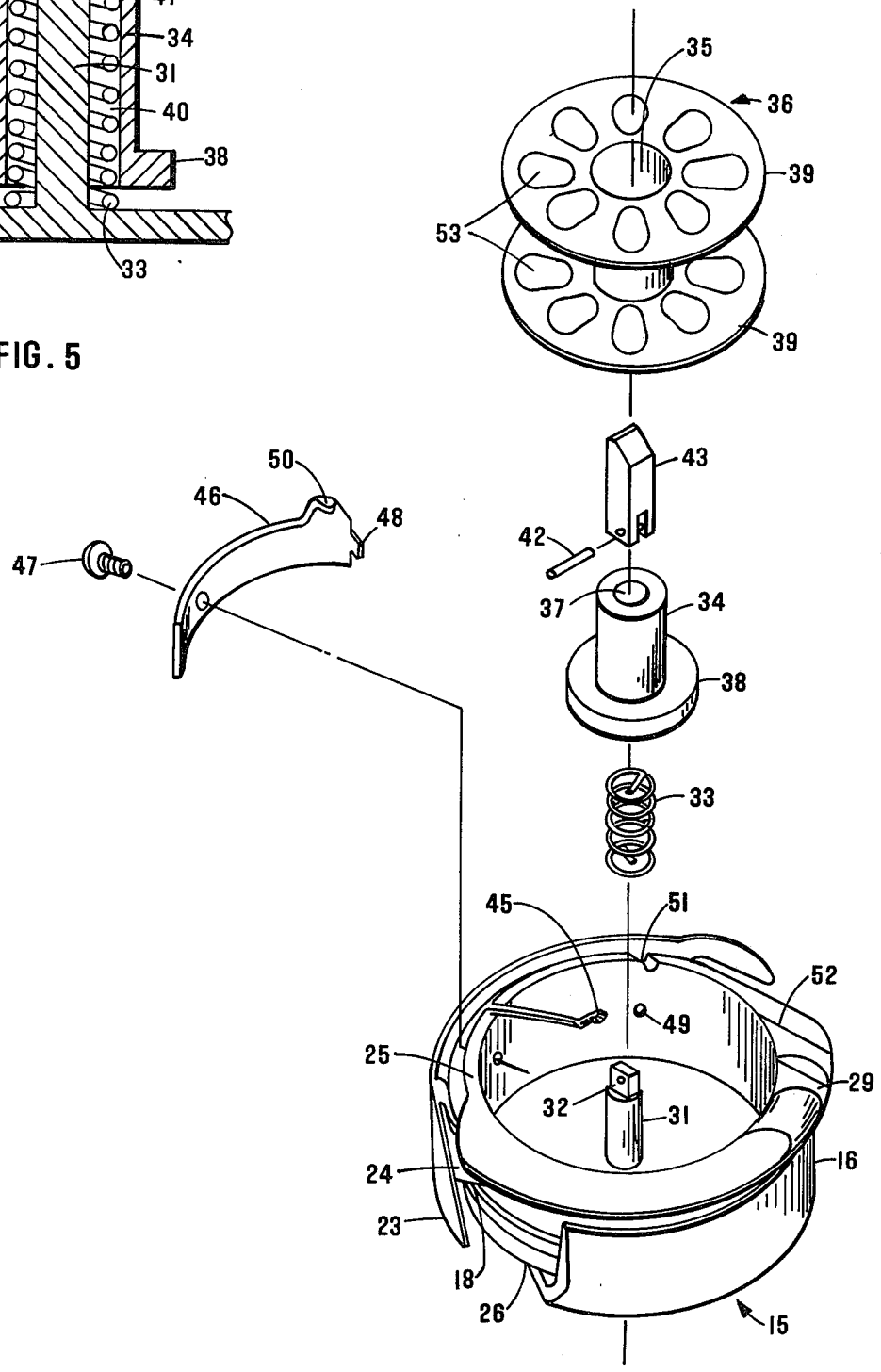
FIG. 4 is an exploded isometric view of the hook assembly.

As shown in FIGS. 3, 4, and 5, a center post 31 projects outwardly from the inside of an end wall of the bobbin case 25 and has its free end formed into a pivot support 32. A bobbin ejector coil spring 33 is installed over center post 31 and a bobbin ejector bushing 34 is installed over center post 31 and coil spring 33. Bobbin ejector bushing 34 has a cylindrical body whose external diameter is sized to rotatably fit within a center bore 35 of a bobbin 36 which is installed over the bobbin ejector bushing. Bobbin ejector bushing 34 also has a small center bore 37 sized to rotatably fit over center post 31, a flange 38 at one end which fits against one flange 39 of bobbin 36, and a larger center bore 40 at the flange end to accept the outer end of ejector coil spring 33. The junction of the small center bore 37 and larger center bore 40 forms a shoulder 41 against which ejector coil spring 33 is compressed when bobbin ejector bushing 34 is inserted into bobbin case 25.

Pivoted to pivot support 32 on the free end of center post 31, on a pivot pin 42, is a latch 43 having a cross-section conforming to that of the cylindrical body of bobbin ejector bushing 34 so that when latch 43 is positioned in axial alignment with center post 31, in the unlatched position as shown in phantom lines in FIGS. 3 and 5, bobbin 36 may be inserted or removed over latch 43. The cross-section of latch 43 is also larger than smaller bore 37 of ejector bushing 34 so that latch 43 will retain ejector bushing 34 on center post 31 in any position.

The pivot end of latch 43 is shaped and proportioned, and pivot pin 42 located, i.e., pivot pin 42 is close enough to a flat end of latch 43 which is at right angles to the inner face thereof and the flat end extends beyond the axis of center post 31, so that when latch 43 is in the unlatched position in axial alignment with center post 31 ejector spring 33 forces ejector bushing 34, and bobbin 36 seated thereon, outwardly from bobbin case 25 so that bobbin 36 may be grasped and removed, and the outer end of bobbin ejector bushing 34 is forced against the end of latch 43, any movement of latch 43 will compress ejector coil spring 33, and thus movement of latch 43 is resisted.

Figure 2:
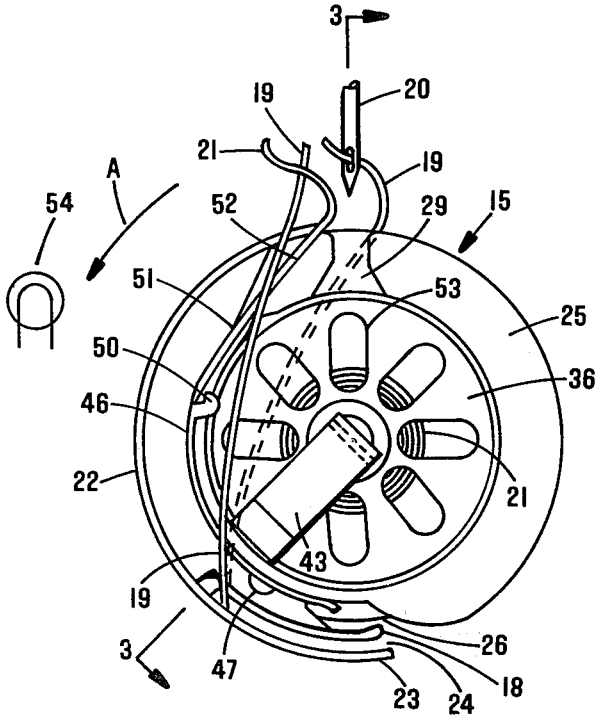
FIG. 2 is an enlarged front view of the stitch-forming mechanism as seen through a bobbin access door in the free arm.

When latch 43 is placed in position at right angles to the axis of center post 31, in a latched position as shown in solid lines in FIGS. 2, 3 and 5, a flat inner face of latch 43 bears against the outer end of bobbin ejector bushing 34, compresses ejector coil spring 33, forces bobbin ejector bushing 34 to remain operably inserted in bobbin case 25, and bobbin 36 mounted on ejector bushing 34 is thereby rotatably constrained in operable position; the pivot end of latch 43 is shaped and proportioned and pivot pin 42 located, i.e. pivot pin 42 is located far enough from the inner face of latch 43 and that inner face extends beyond the axis of center post 31, so that bobbin ejector bushing 34 is forced against the outer end of the inner face of latch 43, any movement of latch 43 compresses ejector coil spring 33 and movement of latch 43 is resisted.

As shown in FIG. 5, another means for biasing latch 43 in the latched and unlatched positions can be provided by a flat spring 44, attached as by brazing to the outer face of latch 43, having a free end forming a cantilever over pivot support 32, so that in the unlatched position, as shown in phantom lines, the free end bears against the side of pivot support 32, any movement of latch 43 flexes flat spring 44, and thus movement of latch 43 is resisted; in the latched position, as shown in solid lines, the free end of flat spring 44 bears against a flat on the outer end of pivot support 32, movement of latch 43 flexes flat spring 44, and movement of latch 43 is resisted.

Referring to FIGS. 2 and 4, bobbin case 25 has a thread guide slot 45 through which bobbin thread 21 is threaded inside to outside of bobbin case 25. Mounted over thread guide slot 45, on the exterior of bobbin case 25 sidewall, is a thread tensioner 46, a curved leaf spring whose radius of curvature is less than that of bobbin case 25 sidewall, attached thereto by a thread tensioner screw 47. Bobbin thread 21 is threaded from thread guide slot 45 between thread tensioner 46 and bobbin case 25 sidewall, thereby applying tension directly to bobbin thread 21 in a known and usual manner. Adjustment of thread tensioner screw 47 adjusts the tension applied to bobbin thread 21, also in a known and usual manner. Thread tensioner 46 has, at one end thereof, a locator prong 48 extending radially inward into locator hole 49 in bobbin case 25 sidewall, and is thus constrained in proper position; and also has, at the thread exit end thereof, a thread guide finger 50 which bears against the outer edge of bobbin case 25 sidewall, constraining bobbin thread 21 between thread tensioner 46 and the circumferential surface of bobbin case 25 sidewall. A bobbin thread groove 51, in the outer edge of bobbin case 25 sidewall proximate to thread guide finger 50, is aligned to direct bobbin thread 21 to a bobbin thread guide shoulder 52 on the outer edge of bobbin case 25 sidewall, adjacent to position finger slot 29, along which bobbin thread 21 exits hook assembly 15.

Removal of bobbin 36 requires positioning of latch 43 to the unlatched position and manual grasping of bobbin 36; removal of no other part, such as a usual bobbin case cap, is required. Furthermore, elimination of the usual bobbin case cap exposes flange 39 of bobbin 36 to view. Bobbin 36, of known construction, either of transparent plastic or opaque material such as metal with flange cutouts 53 in flange 39, provides means for viewing bobbin thread 21 supply through an end flange 39. Free arm sewing machine 11 usually has an access door 13 through which bobbin 36 is removed and replaced; by illuminating hook assembly 15 and bobbin 36 therein by a miniature light bulb 54 inside free arm 12 as shown in FIG. 2, and by providing a magnifying lens window 14 in access door 13 as shown in FIG. 1, the operator at any time can view bobbin thread 21 on bobbin 36 and determine the status of bobbin thread supply.

While the preferred embodiment shows the invention applied to a free arm sewing machine, application to a flat bed model should be obvious.

I claim:

1. A rotary hook, lock stitch, stationary bobbin case, sewing machine with the rotary hook mounted on and rotated by a horizontal shaft; the bobbin case, having a cylindrical sidewall and an inner closed end, rotatably mounted and retained inside the body of the rotary hook; the bobbin case being restrained from rotation with the rotary hook by means of a position finger slot in the sidewall thereof, having a bobbin thread guide shoulder adjacent to the position finger slot and having a center post affixed to the inside of the closed end thereof; a bobbin, having a center bore therein and two end flanges, operably mating with the bobbin case wherein the improvement comprises:

the bobbin case center post having a free end formed to provide a latch pivot support;

a bobbin ejector coil spring installed over the center post with one end against the closed end of the bobbin case;

a bobbin ejector bushing having a cylinderical body sized to rotatably fit the center bore of the bobbin, a smaller center bore sized to rotatably fit the center post of the bobbin case, a flange at one end to fit against one flange of the bobbin, and a larger bore at the flange end to accept the outer end of the ejector coil spring and form a shoulder at the junction with the smaller bore against which the ejector spring is compressed when the bobbin ejector bushing is operably inserted in the bobbin case;

a latch pivoted at the free end of the bobbin case center post;

the latch having a cross-section conforming to that of the cylindrical body of the bobbin ejector bushing so that when positioned in axial alignment with the bobbin case center post the bobbin may be inserted and removed over the latch, and larger than the smaller bore of the bobbin ejector bushing so that the latch will retain the bushing on the center post;

the pivot end of the latch being so shaped and proportioned, and the pivot so located, that when the latch is in axial alignment with the center post, in the unlatched or released position, the ejector spring forces the bobbin ejector bushing with the bobbin seated thereon outwardly from the bobbin case so that the bobbin may be grasped and removed therefrom and so that, when the latch is placed in a position at right angles to the axis of the center post, in a latched position, the inner face of the latch bears against the outer end of the bobbin ejector bushing, causing the bobbin ejector bushing to remain operably inserted in the bobbin case; means for biasing the latch in position when latched and when unlatched;

the bobbin case having a thread guide slot in the sidewall thereof, providing a passageway for bobbin thread to pass to the outside of the bobbin case;

a curved leaf spring bobbin thread tensioner mounted externally on the sidewall of the bobbin case over the thread guide slot and secured thereto by a thread tension adjusting screw;

the thread tensioner having a locator prong inserted into a tensioner locator hole in the sidewall of the bobbin case and a thread guide finger bearing against the outer edge of the bobbin case sidewall constraining the bobbin thread between the tensioner and the circumferential surface of the sidewall of the bobbin case; and the bobbin case having a bobbin thread groove guiding the bobbin thread from the tensioner to the bobbin thread guide shoulder adjacent the position finger slot of the bobbin case;

whereby removal of the bobbin requires only positioning of the latch to the unlatched position and manual grasping of the bobbin and does not require the removal of any other part.

2. The sewing machine of claim 1 in which the means for biasing the latch in latched and unlatched positions comprises:

in the unlatched position, the outer end of the bobbin ejector bushing is forced against the end of the latch, any movement of the latch compresses the ejector coil spring, and thus movement of the latch is resisted;

in the latched position, the outer end of the bobbin ejector bushing is forced against the inner face of the latch, any movement of the latch compresses the ejector coil spring, and movement of the latch is resisted.

3. The sewing machine of claim 1 in which the means for biasing the latch in latched and unlatched positions comprises:

a flat spring attached to the outer face of the latch and cantilevered over the center post of the bobbin case;

in the unlatched position, the free end of the flat spring bears against the side of the bobbin case center post, movement of the latch flexes the flat spring, and thus movement of the latch is resisted;

in the latched position, the free end of the flat spring bears against the outer end of the bobbin case center post, movement of the latch flexes the flat spring, and movement of the latch is resisted.

4. The sewing machine of claim 1 having, in addition:

the bobbin with means for viewing the bobbin thread supply through an end flange thereof;

means for illuminating the bobbin, such as a miniature light bulb, installed adjacent thereto; and means for viewing the bobbin thread, such as a window with a magnifying lens inserted therein;

whereby the thread supply can be inspected at any time.

* * * * *